US005957144A

United States Patent [19]

Neff et al.

[11] Patent Number: 5,957,144

[45] Date of Patent: Sep. 28, 1999

[54] TURBIDITY SENSOR THAT INTERRUPTS DRAIN MOTOR AND WATER VALVE

[75] Inventors: Mark B. Neff; Thomas M. Johnson, both of Jackson, Tenn.

[73] Assignee: Maytag Corporation, Newton, Iowa

[21] Appl. No.: 09/080,528

[22] Filed: May 18, 1998

[51] Int. Cl.[6] ..... B08B 3/00

[52] U.S. Cl. ..... 134/56 D; 134/58 D; 134/57 D; 134/113

[58] Field of Search ..... 134/56 D, 58 D, 134/57 D, 113

[56] References Cited

U.S. PATENT DOCUMENTS

| | | | |
|---|---|---|---|
| 3,539,153 | 11/1970 | Wennerberg . | |
| 3,790,815 | 2/1974 | Karklys | 307/141 |
| 3,870,417 | 3/1975 | Bashark | 356/208 |
| 3,888,269 | 6/1975 | Bashard | 134/57 |
| 4,178,957 | 12/1979 | Hoffman et al. | 134/387 |
| 5,291,626 | 3/1994 | Molnar et al. . | |
| 5,411,042 | 5/1995 | Suzuki et al. . | |
| 5,555,583 | 9/1996 | Berkcan | 8/158 |
| 5,560,060 | 10/1996 | Dausch et al. . | |
| 5,603,233 | 2/1997 | Erickson et al. . | |
| 5,729,025 | 3/1998 | Erickson et al. | 250/574 |
| 5,760,493 | 6/1998 | Outcalt et al. | 307/38 |
| 5,800,628 | 9/1998 | Erickson et al. | 134/18 |
| 5,806,541 | 9/1998 | Cooper et al. | 134/57 D |

*Primary Examiner*—Frankie L. Stinson
*Assistant Examiner*—Paul J. Lee
*Attorney, Agent, or Firm*—Zarley, McKee, Thomte, Voorhees & Sease

[57] ABSTRACT

The dishwasher of the present invention is adapted to skip a drain cycle if the water in the dishwasher is clean enough. The invention uses a turbidity sensor to sense the turbidity of the water. If the sensed turbidity is below a threshold value, the drain motor and the water valve are disabled to prevent the water from being drained and to prevent additional water from being introduced into the dishwasher.

5 Claims, 4 Drawing Sheets

CONTACTS OPEN 8-12 SECONDS
CONTACTS CLOSED 9-15 SECONDS
CONTACTS CLOSED 8-12 SECONDS
CONTACTS OPEN
CONTACTS CLOSED
CONTACTS OPEN OR CLOSED
DETENT

TURBIDITY SENSOR THAT INTERRUPTS DRAIN MOTOR AND WATER VALVE

BACKGROUND OF THE INVENTION

1. Field of the Invention

The present invention relates to dishwashing machines. More particularly, though not exclusively, the present invention relates to a method and apparatus for improving the performance of an automatic dishwashing machine.

2. Problems in the Art

A typical dishwasher includes a washing chamber having side walls, a top wall, a bottom wall, and a wash water circulation system mounted in the bottom wall of the washing chamber. The water circulation system pumps wash water upwardly through a lower rotating wash arm and downwardly through an upper rotating wash arm for spraying water onto the dishes and other articles to be cleaned within the washing chamber. Typically, at the end of each wash or rinse cycle, the water is drained from the washing machine and new water is used during the next cycle.

Various prior art dishwashers use turbidity sensors to sense the cleanliness of the water during a wash or rinse cycle. The sensed turbidity is then used in some manner to control the operation of the dishwasher.

3. Features of the Invention

A general feature of the present invention is the provision of a method and apparatus for providing a control system for a dishwasher which overcomes problems found in the prior art.

A further feature of the present invention is the provision of a method and apparatus for providing a control system for a dishwasher which uses a turbidity sensor to determine the cleanliness of the water after a cycle, and, upon detecting a level of turbidity below a threshold level, interrupts power to the drain and to the water valve, preventing water from draining from, or overfilling the dishwasher.

Further features, objects and advantages of the present invention include:

A method and apparatus for providing a control system for a dishwasher which prevents the dishwasher from overflowing by preventing energization of the water valve if the float (water level sensor) malfunctions when the turbidity sensor interrupts a drain, or when a drain cycle is skipped.

A method and apparatus for providing a control system for a dishwasher which uses a turbidity sensor and a relay connected to the sensor for preventing the drain winding of the motor from being energized under certain conditions.

These as well as other features, objects and advantages will become apparent from the following specification and claims.

SUMMARY OF THE INVENTION

The control system of the present invention is used in a dishwasher to skip a drain cycle if the water within the dishwasher is clean enough. The control system includes a drain motor for draining water from the dishwasher, a water valve for selectively introducing water into the dishwasher, and a turbidity sensor. The turbidity sensor senses the level of turbidity of the water in the dishwasher and disables the drain motor and the water valve if the sensed level of turbidity is below a threshold value.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
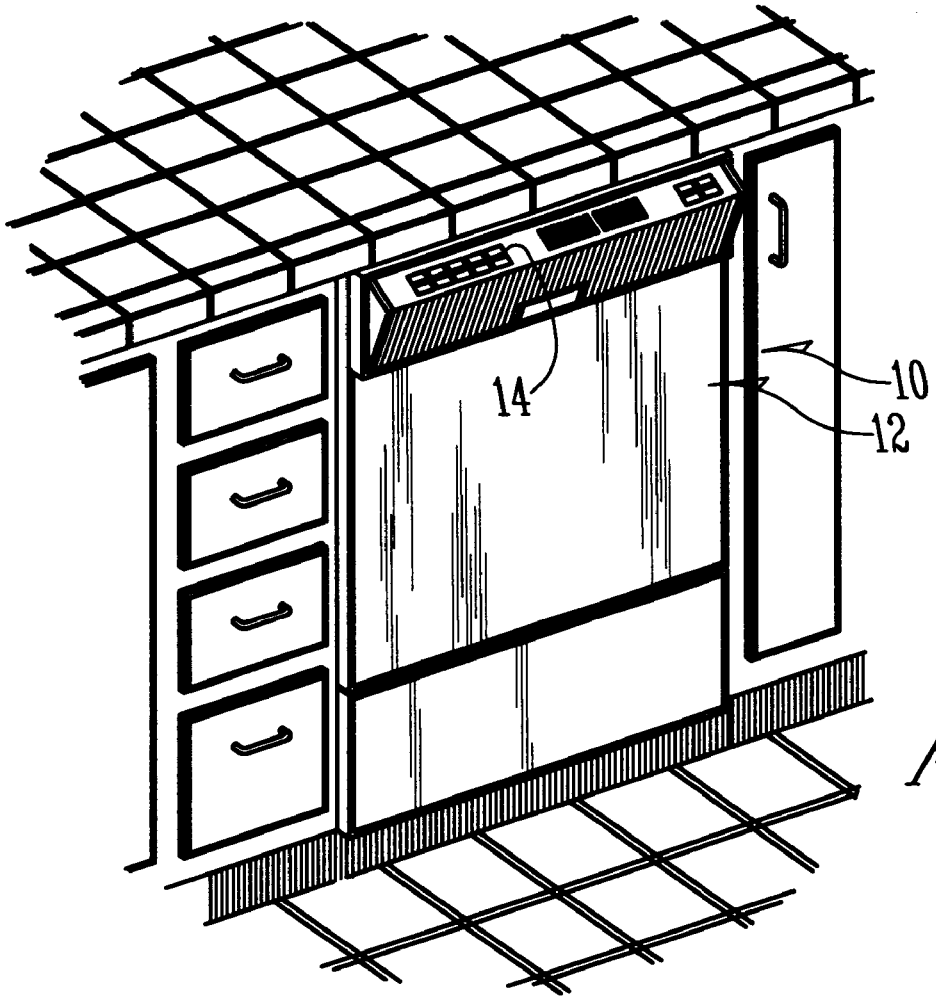
FIG. 1 is a perspective view showing a dishwasher of the present invention.

FIG. 1 shows a dishwasher 10 including an access door 12 pivotally movable between an open position and the closed position shown in FIG. 1. The dishwasher 10 includes side walls, a bottom wall, and a top wall, which together with the access door 12 define a washing chamber. FIG. 1 also shows a control panel including a selector switch 14 which is used by a user to select from various operating modes. Disposed within the washing chamber is a pump assembly for circulating water throughout the dishwasher 10. The above described structure of the dishwasher 10 is conventional and does not, by itself, form a part of the present invention.

Figure 2:
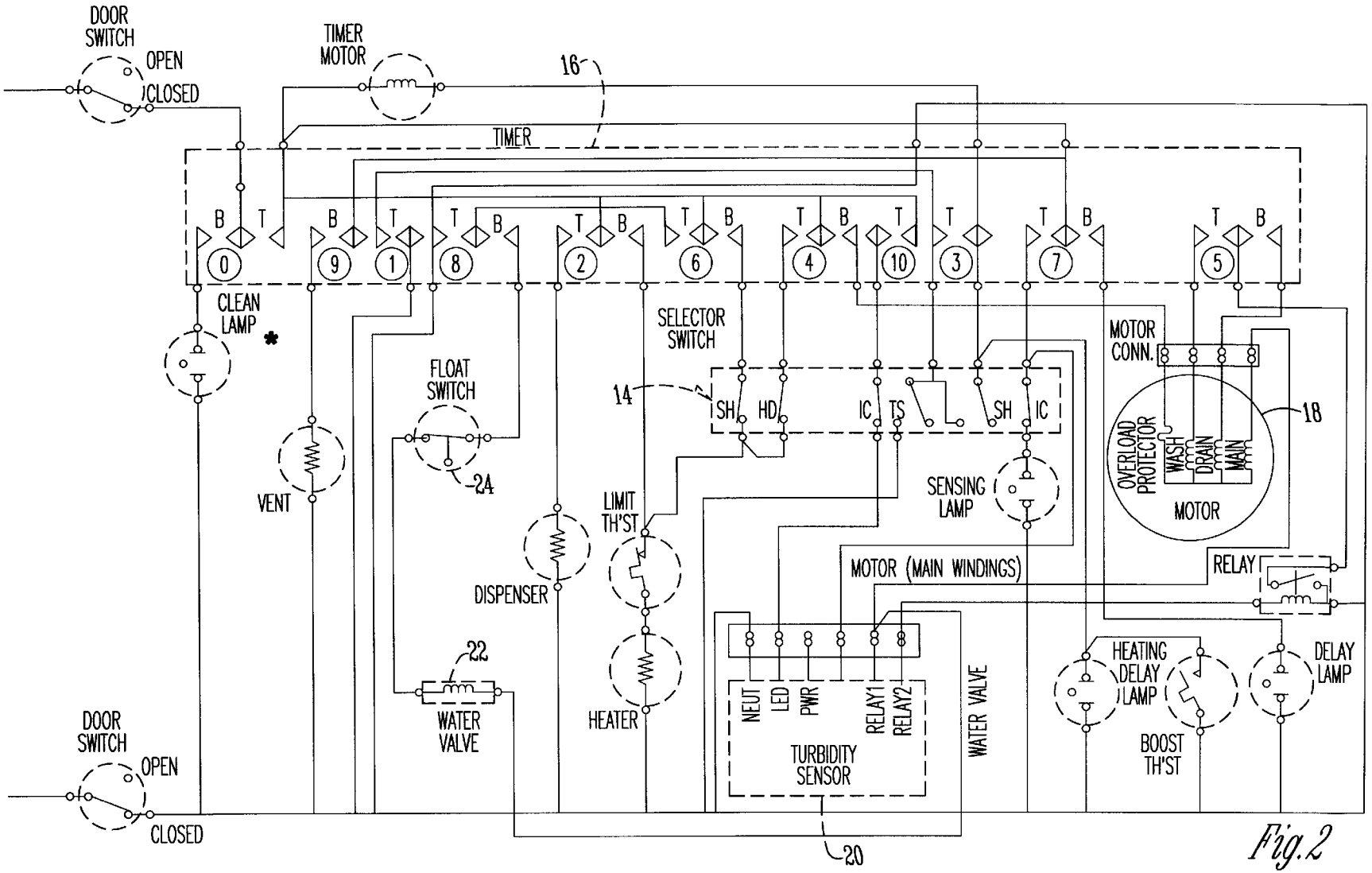
FIG. 2 is an electrical schematic diagram of a circuit used by the present invention.

FIG. 2 is an electrical schematic diagram of the present invention. Among other components, the diagram in FIG. 2 shows the selector switch 14, a timer 16, a dishwasher motor 18 (including main, drain, and wash windings), a turbidity sensor 20, a water valve 22, and a float switch 24.

In general, the various cycles in the dishwasher 10 include the following sequence of steps: fill, circulate, drain, fill, etc. In order to save water in the dishwasher 10, the turbidity sensor 20 is used to sense the cleanliness of the water or quantity of particulate matter in the water after a water circulation period. If the sensed water is clean enough, the next drain cycle is skipped so that the same water can be used again. In order to accomplish this, the turbidity sensor 20 is capable of interrupting the power to the motor 18 (therefore interrupting the power to the drain) so that the same water can be used for the next circulation period. As mentioned above, the turbidity sensor 20 is connected to the motor 18 as well as the water valve 22. When a drain is skipped if the sensed water is clean enough, the sensor 20 interrupts power to the drain winding of the motor 18 which prevents the drain winding from being energized. In addition, the turbidity sensor 20 will also hold the water valve 22 open so that additional water may not enter the dishwasher 10, should the timer contact or the float switch 24 be stuck. Without controlling the water valve 22, the dishwasher 10 could overflow if the drain is skipped and the float switch 24 malfunctions. By controlling the water valve 22 during a skipped drain, the system becomes more reliable. The turbidity sensor closes the circuit to the drain winding of motor 18 and the water valve 22 after the timer 16 has advanced into the next circulating period.

If the dishwasher 10 uses a timed fill and a float switch backup, the present invention keeps the dishwasher from overfilling. If the dishwasher 10 uses a float switch to fill and a timer as a back up, the present invention also keeps the dishwasher from overfilling, in case the float 24 becomes stuck or otherwise malfunctions.

Figure 3A:
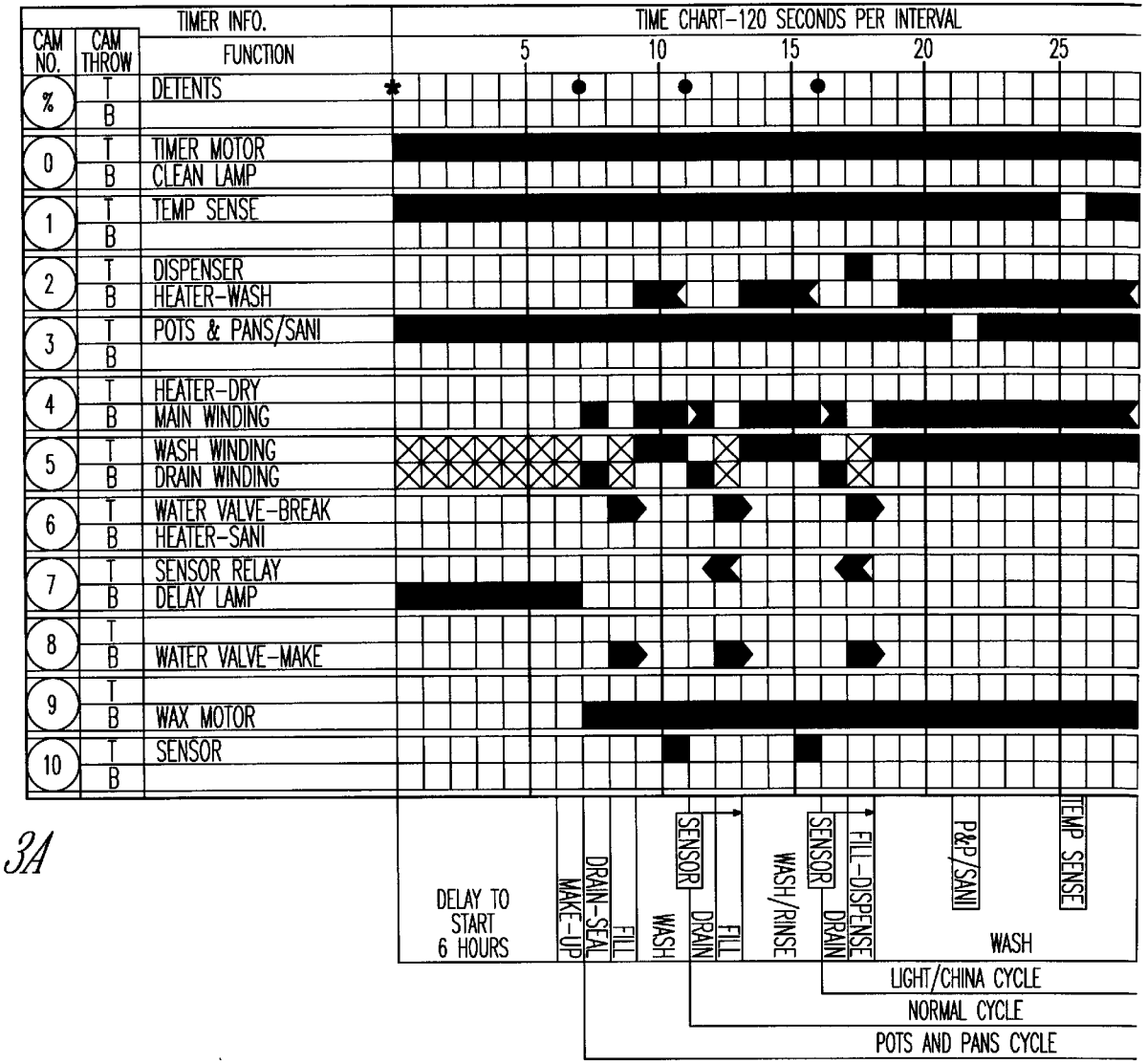
FIGS. 3A–3B show a timing diagram illustrating the operation of the dishwasher of the present invention.
Figure 3B:
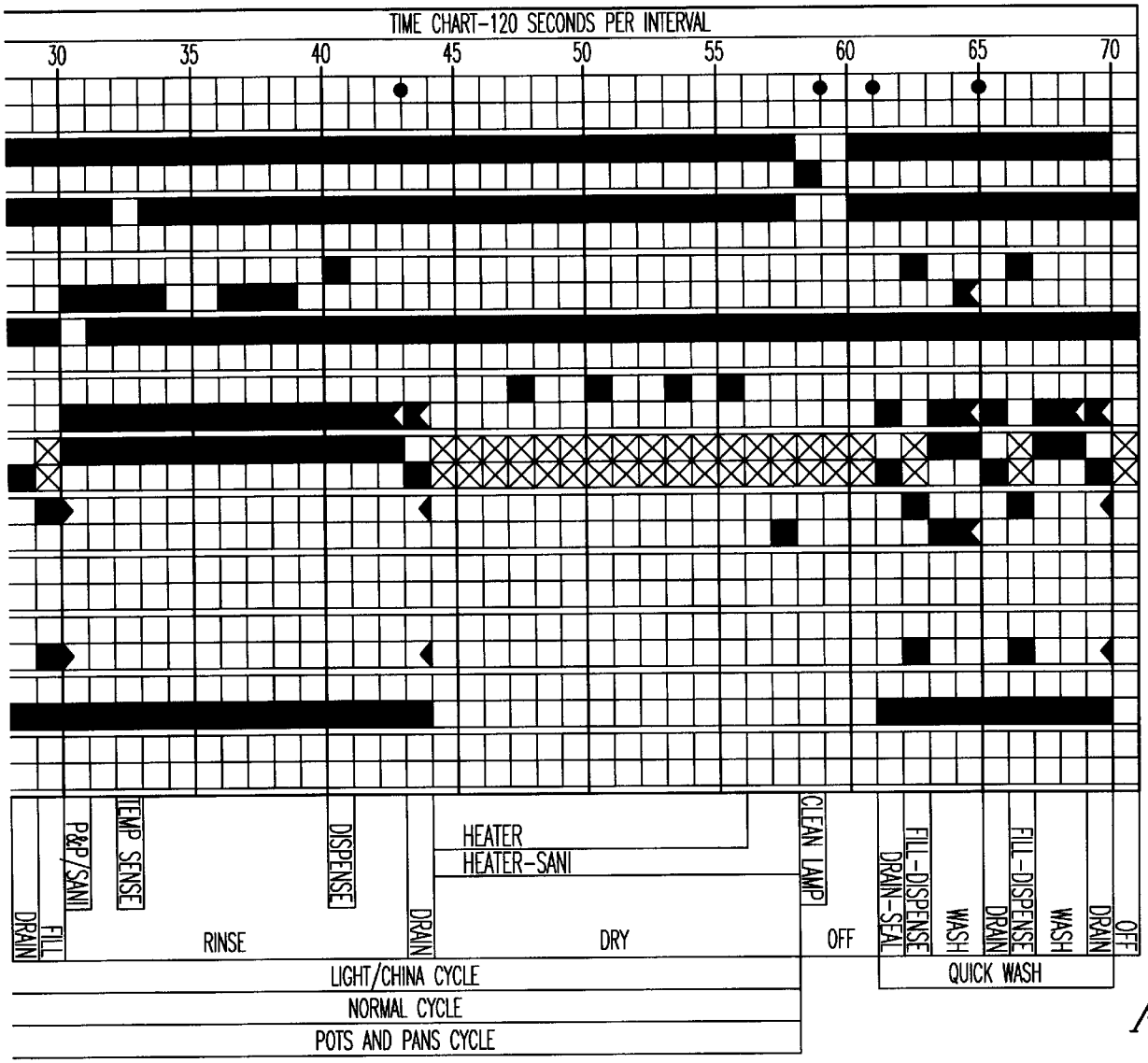

FIGS. 3A and 3B illustrate a timing diagram of the operation of the present invention. As shown in FIG. 3A, the turbidity sensor 20 affects the operation of the dishwasher 10 during the time periods shown. If either of the drain cycles are skipped, the turbidity sensor 20 will prevent the drain winding from energizing, and will disable the water valve 22.

The present invention operates as follows. Initially, a user will select a wash cycle via the selector switch 14. The user may select between various operating modes including sani heat (SH), heated dry (HD), intelliclean (IC), and temperature sense (TS). Of course, the present invention will work with dishwashers having various operating modes, either manual or automatic. The modes listed above are merely examples.

To start the selected operating mode, the dishwasher will fill with water. The filling will stop either when the float switch 24 is tripped, or after a predetermined time interval, depending on the particular dishwasher used. Once the dishwasher 10 is filled, a water circulation cycle will begin (e.g., rinse or wash, etc.). After the circulation period, the turbidity sensor 20 will sense the cleanliness of the water in the dishwasher 10. If the water is dirty enough, the dishwasher 10 will drain the water and fill with clean water for the next cycle, as illustrated in the timing diagram in FIGS. 3A–3B. If the sensed water is clean enough, the water will be reused during the next circulation period. In this case, the turbidity sensor 20 will also disable the drain winding of the motor 18 and will disable the water valve 22. The water within the dishwasher 10 therefore will not drain and additional water will be prevented from entering the dishwasher, preventing any overfilling. The subsequent circulation period then commences using the same water that was used in the previous circulation period.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A control system for a dishwasher having a water circulation system comprising:

a drain motor capable of actuation to drain water from said dishwasher and capable of deactuation to prevent water from draining from said dishwasher;

a water valve being capable of an enabled condition to introduce water to said dishwasher and a disabled condition for preventing introduction of water to said dishwasher;

a water valve control connected to said water valve and being capable of changing said water valve between said enabled and disabled conditions to control the level of water in said dishwasher;

a turbidity sensor disposed within said dishwasher for sensing when the turbidity level of the water in said dishwasher is above or below a predetermined turbidity level;

said turbidity sensor being connected to both said drain motor and said water valve and being responsive to a sensed turbidity level below said predetermined level to deactuate said drain motor to prevent water from draining from said dishwasher and at the same time to cause said water valve to be placed in said disabled condition to prevent introduction of water to said dishwasher.

2. A control system according to claim 1 wherein said water valve control includes a float switch responsive to the water level within said dishwasher for changing said water valve between said enabled and disabled conditions.

3. A control system according to claim 2 wherein said water valve control further includes a timer for changing said water valve between said enabled and disabled conditions.

4. A control system according to claim 1 wherein said water valve control includes a timer for changing said water valve between said enabled and disabled conditions.

5. The control system of claim 1 wherein the drain motor is a part of a main motor having a main winding, a wash winding, and a drain winding, wherein the drain motor is disable by disabling the drain winding of the main motor.

* * * * *